United States Patent [19]

Lee

[11] 4,169,640

[45] Oct. 2, 1979

[54] ELECTRIC PLUG WITH NOVEL MEANS CONNECTING WIRES TO TERMINALS

[76] Inventor: Hop Lee, 2455 - 24th Ave., San Francisco, Calif. 94116

[21] Appl. No.: 895,749

[22] Filed: Apr. 13, 1978

[51] Int. Cl.[2] ..... H01R 3/06

[52] U.S. Cl. ..... 339/14 P; 339/103 C; 339/276 A

[58] Field of Search ..... 339/14 RP, 14 P, 103 C, 339/276 A, 103 R

[56] References Cited

U.S. PATENT DOCUMENTS

| | | | |
|---|---|---|---|
| 1,721,207 | 7/1929 | Cunningham | 339/103 R |
| 2,986,718 | 5/1961 | Bender, Jr. | 339/14 RP |
| 3,461,417 | 8/1969 | Schumacher et al. | 339/14 P |

*Primary Examiner*—Roy Lake

*Assistant Examiner*—DeWalden W. Jones

*Attorney, Agent, or Firm*—William R. Piper

[57] ABSTRACT

An electric plug that has a pivoted "ground" terminal which may be swung from operative to an inoperative and protective position. The base for the "ground" terminal as well as the base for each of the two electrodes are provided with integral hook-shaped projections around which the bare strands of each wire in the three wire cable can be tightly wound for making an electrical connection between the bare strands of a wire and its associate base. In addition, the terminal carrier that receives the three wire cable has one end received in an end cap provided with recesses for receiving the outer ends of the hook-shaped projections. Also, the end cap has shoulders for pressing the bare strands of the wires into intimate contact with its associate base.

1 Claim, 8 Drawing Figures

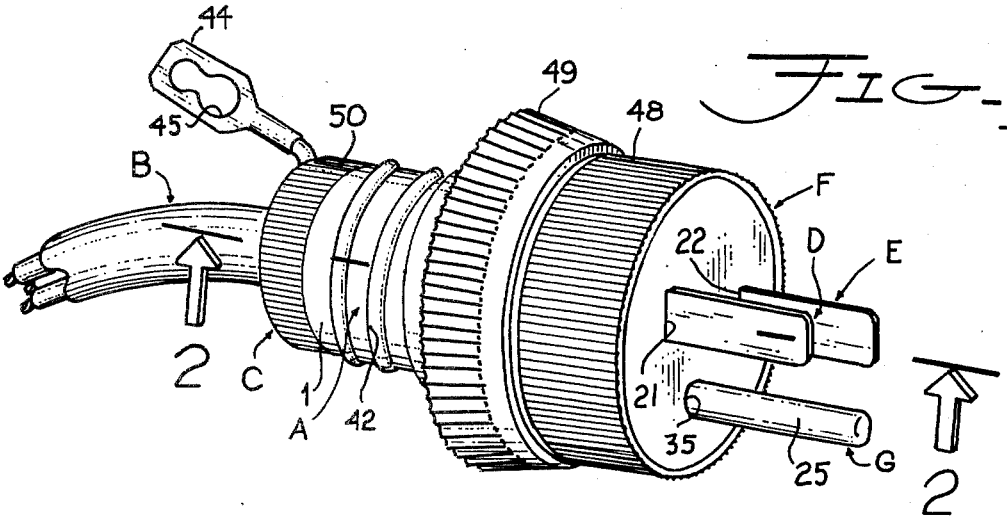
FIG-1-
FIG-2-
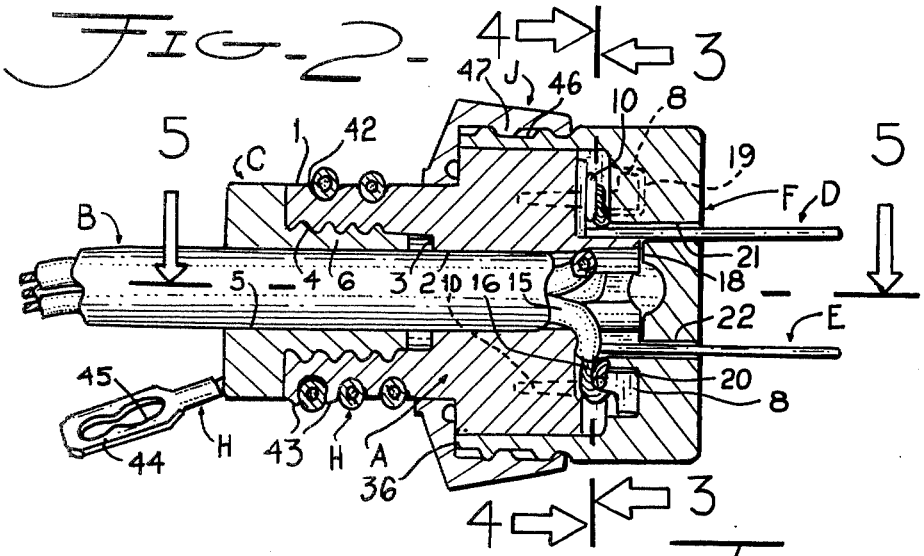
FIG-4-
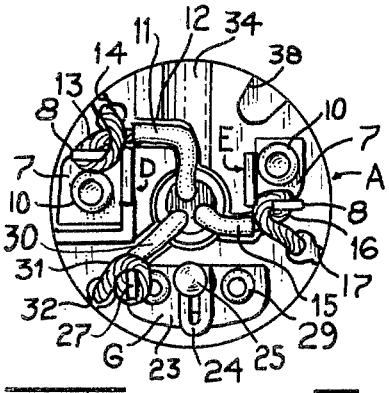
FIG-3-
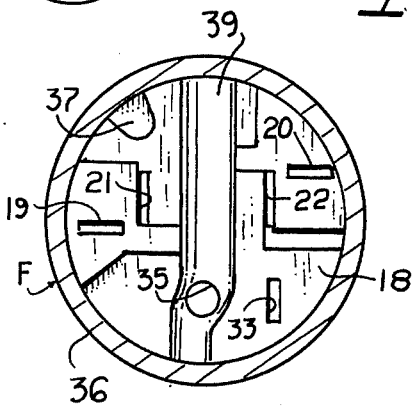

FIG. 8.
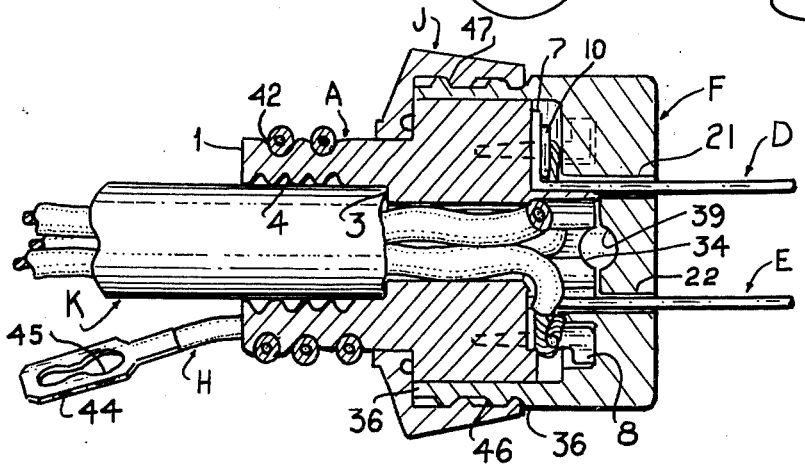
FIG. 5.
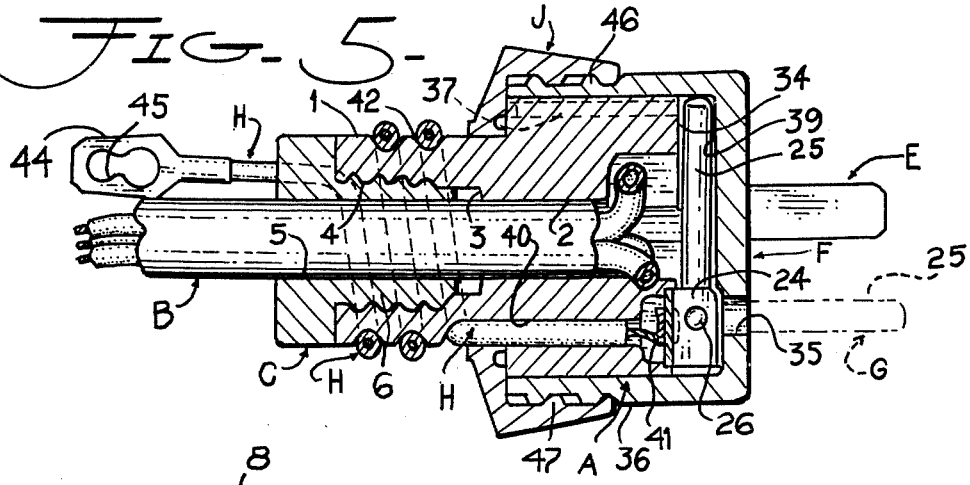
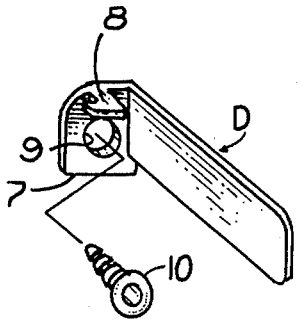
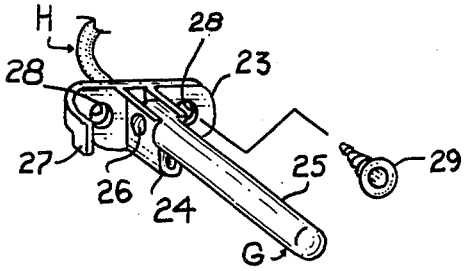
FIG. 6. FIG. 7.

ELECTRIC PLUG WITH NOVEL MEANS CONNECTING WIRES TO TERMINALS

SUMMARY OF THE INVENTION

This invention is an improvement over the electric plug with retractable ground terminal disclosed in my co-pending application Ser. No. 769,839, filed Feb. 17, 1977, patented Mar. 28, 1978 U.S. Pat. No. 4,081,206, and over the electric plug disclosed in my co-pending application, Ser. No. 886,669, filed Mar. 15, 1978.

In the earlier case I showed a ground terminal electrically connected to the ground wire in the plug only when the ground terminal cannot be used and is swung into a retracted position and concealed from view. In the second case, Ser. No. 886,699, the novelty lies in the means for providing an electrical connection between the wires and the electrodes without the need for screws for connecting them together. The various parts of the plug are so designed that the mere assembling of these parts together will at the same time provide a binding electrical connection between the wires and their associate electrodes.

The present invention discloses a modified form for electrically connecting wires to hook-shaped projections on the electrode bases and then using an end cap with recesses for receiving the outer ends of the hook-shaped projections, the end cap also having portions for clamping the wires to the electrode bases.

BRIEF DESCRIPTION OF THE DRAWINGS

FIG. 1 is a perspective view of the electric plug.

FIG. 2 is a longitudinal section taken along the line 2—2 of FIG. 1.

FIG. 3 is an end view of the terminal carrier when looking in the direction of the arrows 3—3 of FIG. 2.

FIG. 4 is rotated through an angle of 90° from its position in FIG. 2.

FIG. 5 is a longitudinal section taken along the line 5—5 of FIG. 2 and shows the pivoted "ground" terminal in retracted position by full lines and in extended or operative position by double dot-dash lines.

FIG. 6 is a perspective view of one of the two electrodes.

FIG. 7 is a perspective view of the "ground" terminal.

FIG. 8 is a longitudinal sectional view similar to FIG. 2, except that the insert of FIG. 2 is omitted which permits the terminal carrier to receive a cable of a larger diameter than that shown in FIG. 2.

DESCRIPTION OF THE PREFERRED EMBODIMENT

In carrying out my invention I provide a terminal carrier indicated generally at A, in FIGS. 2 and 3. This terminal carrier has a reduced cylindrical portion 1, and an axial bore 2 with an annular shoulder 3 and an internally threaded portion 4, see also FIG. 8. The smaller diameter portion of the bore 2 in the terminal carrier A, is designed to receive a smaller diameter cable B, as shown in FIGS. 2 and 5. When this is done, an insert C, is used and it has an axial bore 5 for receiving the cable B, and it has an exterially threaded neck portion 6 for screwing into the threaded bore portion 4 of the terminal carrier A. The insert will be described more in detail hereinafter.

The terminal carrier A has two electrodes and a retractable "ground" terminal connected thereto. The two electrodes D and E, see FIGS. 1 and 2, and I have shown the electrode D, in perspective in FIG. 6. A description of this electrode will suffice for both. The electrode D has an integral base 7, extending at right angles to the length of the electrode. The base 7 has an integral hook-shaped projection 8 and the base also has an opening 9 therein for receiving a standard hollow eyelet 10 that may be driven through the opening 9 and into the body of the terminal carrier A for securing the electrode thereto, see FIG. 2.

In FIG. 3, I show the electrode D secured to the end of the terminal carrier A by the eyelet 10. The same Figure also shows the electrode E secured in place on the terminal carrier in the same manner. The cable B, contains the standard three wires, one of these wires being the "ground" wire while the other two wires are connected to the electrodes D and E, in a novel manner that does away with the necessity of using a screw. One of the cable wires 11, is shown in FIG. 3, as being received in a groove 12 provided in the end of the terminal carrier A. The bare metal strands 13 of this wire 11 are shown wrapped around the hook-shaped projection on the electrode base 7 so as to underlie the hooked portion. The ends of the metal strands 13 are then fed into a longitudinally extending groove 14 formed in the outer cylindrical wall of the terminal carrier A.

What I have described for electrically connecting the wire 11 to the electrode D, is followed in the same manner when connecting the wire 15 of the cable B, to the electrode E. The bare metal strands 16 of the wire 15 are wrapped around the hook-shaped projection 8 for the electrode E, as shown in FIG. 3, and the ends of these metal strands 16 are received in a longitudinally extending groove 17 formed in the outer cylindrical wall of the terminal carrier A.

Referring to FIG. 4, which shows the inner end wall 18 of an end cap F, provided with a recess 19 for receiving the top of the hook-shaped projection 8 for the electrode D, and shows another recess 20 for receiving the top of the hook-shaped projection 8 for the other electrode E. The end cap F, has a slot 21 through which the electrode D, extends when the end cap is mounted on the terminal carrier A. Also, another slot 22 in the end cap receives the electrode E, and FIGS. 1 and 2 show the two electrodes projecting beyond the end cap.

FIG. 2 further shows how the recesses 19 and 20 receive the tops of the hook-shaped projections 8 of the electrodes D and E. The inner end wall 18 of the end cap F has flat portions adjacent to the entrances to the recesses 19 and 20 for contacting the bare metal strands 13 and 16 of the wires 11 and 15, respectively, for clamping them in intimate electrical contact with the metallic bases 7 of the electrodes D and E, is assured without the need of using screws as binding posts for the wires.

The electric plug also has a pivoted "ground" terminal G, and a perspective view of it is shown in FIG. 7. A metal base 23 has an integral clevis 24 and a rod-shaped terminal 25 has its inner end pivoted at 26 to the clevis. The base 23 also has an integral hook-shaped projection 27, and it has a pair of openings 28 through which hollow eyelets 29 are driven and into the body of the terminal carrier A. FIG. 3 shows a top plan view of the "ground" terminal actually connected to the terminal carrier with the pivoted rod 25 in extended or operative position.

The "ground" wire 30 in the cable B, extends beyond the casing for the cable and has its bare metal strands 31, see FIG. 3, wrapped around the hook-shaped projection 27 on the "ground" terminal base 23 with the ends of the strands received in a longitudinally extending groove 32, provided in the cylindrical periphery of the terminal carrier A. When the end cap F, receives the end of the terminal carrier, the outer end of the hook-shaped projection 27 on the "ground" terminal G, is received in a recess 33, in the end cap as shown in FIG. 4. The inner surface 18 of the end cap will press down upon the bare metal strands 31 of the "ground" wire 30 and form an intimate electrical connection between the strands and the "ground" terminal G.

When the pivoted rod 25 of the "ground" terminal G, is in retracted or inoperative position, as shown by the full lines in FIG. 5, it is received in a groove 34 formed in the end of the ground terminal, see also FIG. 3. The closed end of the end cap F has an opening 35 therein for receiving the terminal rod 25 when the latter is swung into operative position as shown in FIGS. 1 and 5. It is essential that the end cap F be properly aligned with the terminal carrier A, before the end cap is slipped over the terminal carrier. To accomplish this, I provide the cylindrical skirt 36 of the end cap with a longitudinally extending key 37 on its inner surface, see FIGS. 4 and 5. This key 37 slides in the longitudinally extending keyway 38 in the cylindrical periphery of the terminal carrier A when the skirt 36 of the end cap F, is telescoped over the terminal carrier. The inner end wall 18 of the end cap F, has a diametrically extending groove 39 therein for receiving a portion of the terminal rod 25, when the latter is in retracted position and the end cap encloses the terminal carrier, see FIGS. 4 and 5.

An independent "ground" wire H, has one end received in a longitudinally extending bore 40 in the terminal carrier A, see FIG. 5, and the bare metal strands 41 of this wire are soldered to the base 23 of the retractable "ground" terminal G. When the terminal rod 25 of the "ground" terminal G, is in retracted position, the exposed portion of the independent "ground" wire H, is wound around the reduced cylindrical portion 1 of the terminal carrier A, and is received in a helical groove 42 formed in the cylindrical outer surface of the reduced portion 1 of the terminal carrier A. In FIG. 2, I show one portion of the helical groove 42 reduced slightly in width at 43 for frictionally gripping the adjacent sides of the wire H, and preventing its accidental unwinding from the helical groove. The free end of the wire H, has a metal clip 44 with a key hole opening 45 therein for permitting this clip to be attached to a "ground" screw, not shown, in an electric outlet box, not shown, when the terminal rod 25 is retracted and enclosed in the end cap F.

The end cap F, is secured to the terminal carrier A by a coupling connector J, see FIGS. 1, 2, 5 and 8. The cylindrical skirt 36 of the end cap F, is exterially threaded at 46 and the coupling connector is internally threaded at 47 so that the two may be interconnected. The coupling connector J has a central opening through which the reduced portion 1 of the terminal carrier extends.

When a larger diameter cable K, is used, the insert C, is not used, see FIG. 8. The covering for the larger diameter cable K, has its end abutting the annular shoulder 3 in the terminal carrier A, and the three wires in the cable are connected to their respective electrodes D and E, and to the "ground" terminal G, in the same manner as already described. Therefore, no further description is needed.

The outer cylindrical surface of the end cap F, is knurled at 48, and the outer cylindrical surface of the coupling connector J, is knurled at 49, see FIG. 1. Also, the exposed outer end of the insert C, is knurled at 50.

I claim:

1. An electric plug comprising:

(a) a terminal carrier having an axial bore for receiving a cable carrying three wires;

(b) electrodes secured to said terminal carrier, each electrode having an integral base with a hook-shaped projection around which the bare metal strands of the wires are wrapped for electrically connecting the wires to their associate electrodes;

(c) said terminal carrier having longitudinally extending grooves in its outer periphery and disposed adjacent to the hook-shaped projections for receiving the ends of the bare metal wire strands that extend beyond the wrapped wire portions;

(d) an end cap having a cylindrical skirt for receiving the adjacent end of said terminal carrier, said cap having openings in its closed end through which said electrodes project, the inner surface of said closed end having recesses for receiving the outer ends of said hook-shaped projections and the surfaces adjacent to the recesses contacting the bare wire strands and pressing them into electrical contact with the electrode bases;

(e) the cylindrical skirt of said end cap enclosing the grooves in the terminal carrier for retaining the bare wire strands therein; and (f) a coupling connector rotatably mounted on a reduced cylindrical portion of said terminal carrier, said coupling connector having a portion bearing against a shoulder on the terminal carrier and having a threaded connection with the threads on the end cap so that when said coupling is rotated in one direction it will force the terminal carrier into the end cap and cause the hook-shaped portions to enter the end cap recesses and the end cap surfaces disposed adjacent to the recesses to force the bare wire strands into an electrical contact with bases on the electrodes, this arrangement being the only means for providing a continuous clamping pressure of the bare wire strands on the electrode bases.

* * * * *